US005787519A

United States Patent [19]

Smith

[11] Patent Number: 5,787,519

[45] Date of Patent: Aug. 4, 1998

[54] COMPACT SWIMMING POOL FOR RESTRAINED SWIMMING

[76] Inventor: Robert Leslie Smith, 45 Clarendon Rd., St Heliers, Auckland, New Zealand

[21] Appl. No.: 666,319

[22] PCT Filed: May 29, 1995

[86] PCT No.: PCT/NZ95/00044

§ 371 Date: Jul. 3, 1996

§ 102(e) Date: Jul. 3, 1996

[87] PCT Pub. No.: WO95/33112

PCT Pub. Date: Dec. 7, 1995

[30] Foreign Application Priority Data

May 31, 1994 [NZ] New Zealand ..... 260637

[51] Int. Cl.[6] ..... E04H 4/00

[52] U.S. Cl. ..... 4/496; 4/488

[58] Field of Search ..... 4/494, 496, 488, 4/490, 491, 538; 482/55

[56] References Cited

U.S. PATENT DOCUMENTS 4,133,059 1/1979 Baker ..... 4/494

4,146,937 4/1979 Baker ..... 4/494

5,601,514 2/1997 Horn ..... 482/55

FOREIGN PATENT DOCUMENTS 4328305 3/1994 Germany ..... 4/496

*Primary Examiner*—David J. Walczak

*Attorney, Agent, or Firm*—Young & Thompson

[57] ABSTRACT

A compact, free-standing swimming pool (900) adapted for vigorous exercising by a harness-restrained swimmer; the pool including a surrounding gutter (903) behind a skimming sill (904) and in front of a ledge, so that most of the water splashed about is retained and so that waves are largely absorbed by falling over the sill and not returning. Baffles (917) placed deep within the pool can break up "slop" type waves. The gutter is emptied by drain pipes (916) leading to a pump (910) for recirculating the water shifted by the swimmer into the gutter back through conduits (914) into the pool. The pump instead recirculates pool water when gutter water is not present. Optional heating, filtration, chlorination, and recirculation current devices (912, 913) may be included.

6 Claims, 4 Drawing Sheets

COMPACT SWIMMING POOL FOR RESTRAINED SWIMMING

TECHNICAL FIELD OF THE INVENTION

This invention relates to sporting equipment, and training devices for swimmers, and more particularly to a compact swimming pool provided with water-retaining means, and harness equipment suitable for swimming exercises.

BACKGROUND OF THE INVENTION

In order to become proficient in swimming it is necessary to practice—often over long periods of one or more hours per day—in order to swim tens or a few hundred kilometres per week. Practice is a relatively difficult thing for a swimmer to manage because swimming pools of sufficient size and available for practice are often situated at inconvenient places and open for practice at inconvenient times. Natural bodies of water may be inconveniently cold for some or most of the year—and in some countries may be hazardous at other times.

Less seriously involved people find regular swimming rather difficult to maintain. The actions of swimming are difficult to emulate with equipment not involving water.

If water is involved, it is difficult and/or expensive to provide the large volume required for serious practice. It has hitherto been difficult to simulate the behaviour of a large pool within a small one.

A further application for the motions of swimming is in physiotherapy—in rehabilitation of patients after trauma or surgery, or with disabled people. Swimming is particularly useful for conditions involving lesions of the vertebral column.

Although free-standing or compact swimming pools have been devised over many years, there seems to be none that include effective means to dampen the waves or surface turbulence that an actively training swimmer may generate; which waves tend to disrupt the training conditions if they are left uncontrolled.

OBJECT OF THE INVENTION

It is an object of this specification to provide a compact swimming pool, catering to swimming practice applications, or at least to provide the public with a useful choice.

SUMMARY OF THE INVENTION

In a first broad aspect the invention comprises a compact swimming pool which provides a reservoir for a charge of water; the compact swimming pool providing means capable of restraining motion in at least one direction of a user exercising in water within the compact swimming pool, and the compact swimming pool being equipped with means to trap surface turbulence or waves that may in use be set up by the user.

In a related aspect the invention comprises a compact swimming pool wherein the means to restrain motion comprises a harness, capable of attachment to the swimmer's body; the harness being resiliently coupled to a fixed point.

In a related aspect the invention comprises a compact swimming pool wherein the means to trap waves comprises a gutter into which waves may spill, over a skimming lip, and hence be unable to return from within the gutter; the lip of the gutter being placed at the level of the surface of the charge of water and substantially surrounding the charge of water.

In a related aspect the invention comprises a compact swimming pool wherein further means are provided to maintain the level of the water within the compact swimming pool at a desired average level.

In a related aspect the invention comprises a compact swimming pool wherein the means to maintain water level comprises a valve connected at the exit of a water supply line; the valve being equipped with control means capable of admitting water if the average level of the water within the compact swimming pool falls below a threshold.

In a related aspect the invention comprises a compact swimming pool wherein the means to maintain water level additionally comprises means to pump the water that has collected within the gutter and return it through one or more conduits into the interior of the compact swimming pool.

In a related aspect the invention comprises a compact swimming pool wherein the means to pump water is provided with a source of water directly from within the compact swimming pool in the event of there being insufficient water within the gutter to act as a source; said provision being by means of a valve having control means preferentially selecting the gutter source if sufficient water is present.

In a related aspect the invention comprises a compact swimming pool wherein at least one of the conduits returning water to the compact swimming pool are provided with in-line water conditioning apparatus.

In a second broad aspect the invention comprises a compact swimming pool for providing a swimmer with a training installation, the compact swimming pool comprising a tank for holding water, restraint means to hold a training swimmer in a relatively stationary position within the compact swimming pool, and means to minimise any turbulence generated by the swimmer during training; the turbulence-minimising means including:

(a) a gutter having a skimming lip and means to remove water from within it, mounted about the perimeter of the compact swimming pool so that the skimming lip is at about the average water level, (b) means to maintain the average water level at the height of the skimming lip, and (c) baffles for subduing internal turbulence deep within the swimming pool.

In an alternative aspect, the invention comprises a container for a volume of water, including (a) swimmer restraint means, and (b) wave trap means.

Optionally the invention may also provide either or both of (c) water recirculation means, and (d) automatic filling.

Preferably the container comprises a substantially waterproof liner and preferably the liner is supported against the weight of water by a framework.

Preferably the framework is comprised of modular elements, so that pools of different sizes may be constructed and so that the pool can be disassembled and stored, or refabricated from time to time.

Preferably the frame is constructed from fibre-glass, or coated steel forms, coated with galvanised zinc, or powder-coating material, or the like.

A preferred steel form has a "U" section, encompassing the width of the pool, and is attached to adjacent steel forms by fasteners passing through apertures in peripheral flanges.

One preferred fibreglass form comprises a half-tank, joined to a similar half along a flange.

Preferably the swimmer restraint means comprises a harness to be worn by the swimmer, coupled by means of an extensible coupling to one end of the pool.

Optionally the extensible coupling comprises an extensible cord, or a substantially inextensible cord tied to an extensible support, or a combination of an extensible cord and a resilient support.

Preferably the extensible cord is a "bungy cord" and preferably the extensible support is a substantially vertical flexible rod.

Optionally specialised harnesses—or none at all—may be used with people whose mobility is compromised and who may require specific exercises.

Preferably the uppermost edge or rim of the waterproof liner is provided with a drain or gutter, connected to water recirculating apparatus such as an axial or centrifugal pump.

Optionally filtering means is provided within the gutter water circulation path.

Preferably the drain or gutter is situated externally although optionally it may be situated internally.

In another aspect the invention also includes a water filtration device.

In a still further aspect the invention also includes a water heater.

Preferably this pool is also fitted with a water sterilisation device, such as one using oxidising properties of chloride or hypochlorite ions as a disinfectant.

In another aspect this invention also comprises a method of using a pool of the type described, comprising the steps of assembling it, filling it with water to the point of overflow, operating the water pump which returns gutter water to the pool, tying oneself into a harness, linking the harness to the restraining cord, getting into the pool, and repeatedly contracting various muscles in a coordinated sequence as for swimming.

BRIEF DESCRIPTION OF THE DRAWINGS

The examples to be described and illustrated herein are given by way of example only, and is in no way intended to be limiting as to the scope or nature of the invention.

DETAILED DESCRIPTION OF THE INVENTION

EXAMPLE 1:

The preferred apparatus of this invention comprises:

(a) an open container for water, preferably about 3.5 metres long, 2 metres wide and 1 metre deep, (b) a surrounding gutter or wave trap, coupled to means to return the water to the container, (c) a harness and restraining line, which may be extensible, connected to a part of the structure of the container, and (d) optional water care means; filters, heaters and the like.

This preferred embodiment provides a local environment in which a person can practice the motions of swimming, making even strenuous movements, while the restraint causes him or her to remain substantially stationary on the surface of the water within the container, and waves are suppressed. Trials with a vigorous swimmer in the prototype pool have shown that the wave action within the pool when filled to the optimum level for wave cancellation is similar to that of a 30-foot pool, although if the internal water level is allowed to drop then surges from end to end become noticeable.

In more detail, the open container is made of modular, prefabricated parts so that it can be taken down and stored or transported, or put up, filled with water, and used. A watertight container of approximately the preferred dimensions is preferably made from a fabric suitable for a watertight liner, held and supported within a series of panels, which in turn are supported by frames. Replication of parts is preferred in order to minimise costs and provide modularity.

Figure 1:
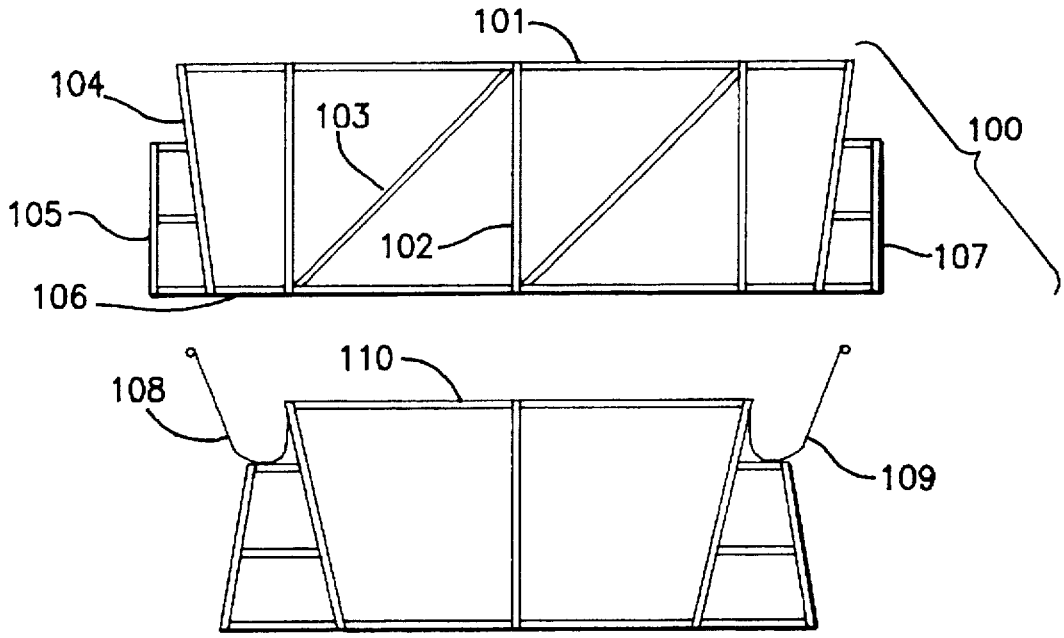
FIG. 1: shows framing structures for the pool in front and end (including gutter) elevations.
Figure 2:
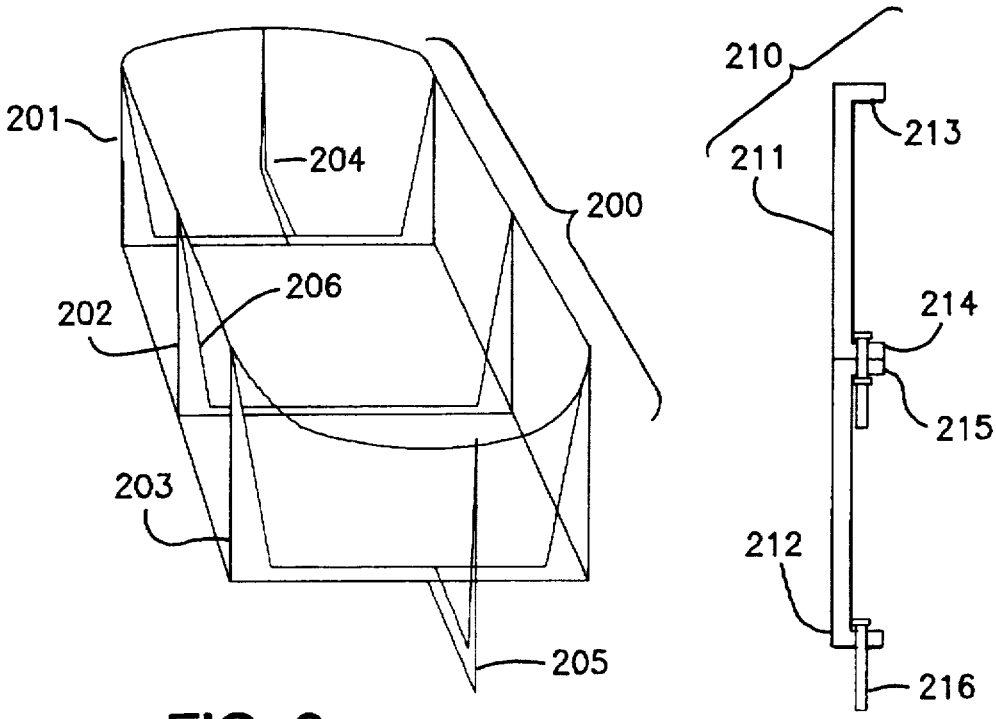
FIG. 2: shows the framework supporting the liner of the pool, and an alternative (in section).

FIG. 1 shows one preferred arrangement 100 of a galvanised pipe structure used as a framework for a pool. In the upper illustration, as seen from one side, horizontal beam 101 is the upper border (also 302), 106 is a support lying on the ground, 102 is a vertical support, 103 is a diagonal brace, and 105 with 107 are end supports. A preferred gutter profile is indicated at 108. FIG. 2 shows a perspective view of side and end frames in another version of the pool. In this view, 204 and 205 are end frames, 201, 202 and 203 are verticals, and 206 is an optional liner support. As an optional variation on construction, FIG. 2 also includes at 210 a section through two adjacent panels 211, 212 of a preferred type. These panels have a "U" profile as seen from an end of the pool, and are attached to one another by bolts 215, 216 (or other suitable fasteners) through flanges 213, 214 provided at each long edge of the panels. The thicknesses of the panels are somewhat exaggerated in the drawing. End panels according to this alternative may conveniently be half-hemispherical flanged panels or some similar shape amenable to production. If these panels were made of coated metal, a pressing operation would be a suitable manufacturing method to make panels. Shipping of the components of a pool according to this invention may conveniently be done by using these panels to surround smaller items such as a folded liner and the pumps.

If a suitable seal is incorporated in the gaps between flanges (e.g. between 214 and 215) it may be possible to create a watertight joint on assembly, and thereby dispense with an inner waterproofing liner. The watertight liner 304 may for example be a shaped sheet of a plastics material, such as polyvinyl chloride, permeating and surrounding a woven structure of polypropylene or similar fibrous material. Preferably the liner is durable, wear-resistant, and resistant to the action of any additives put in the water for bactericidal purposes or the like, and preferably it is resistant to ultraviolet light for those instances where the apparatus is used outside. We imagine that the invention will usually be used in a garage or a basement room.

Figure 3:
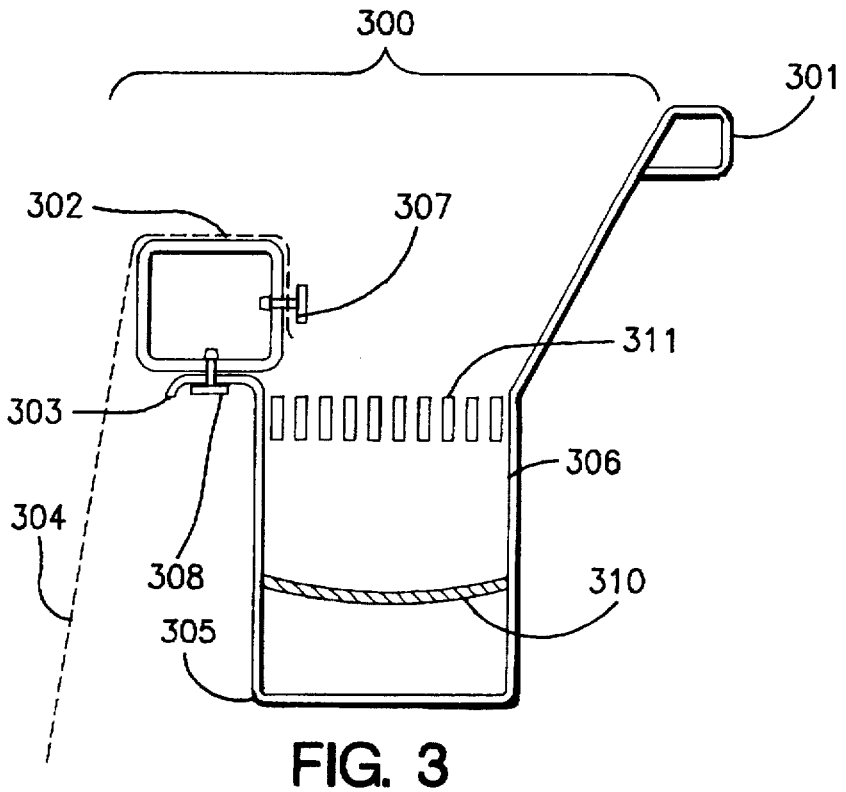
FIG. 3: shows a sectional view of the guttering about the edges of the pool.
Figure 8:
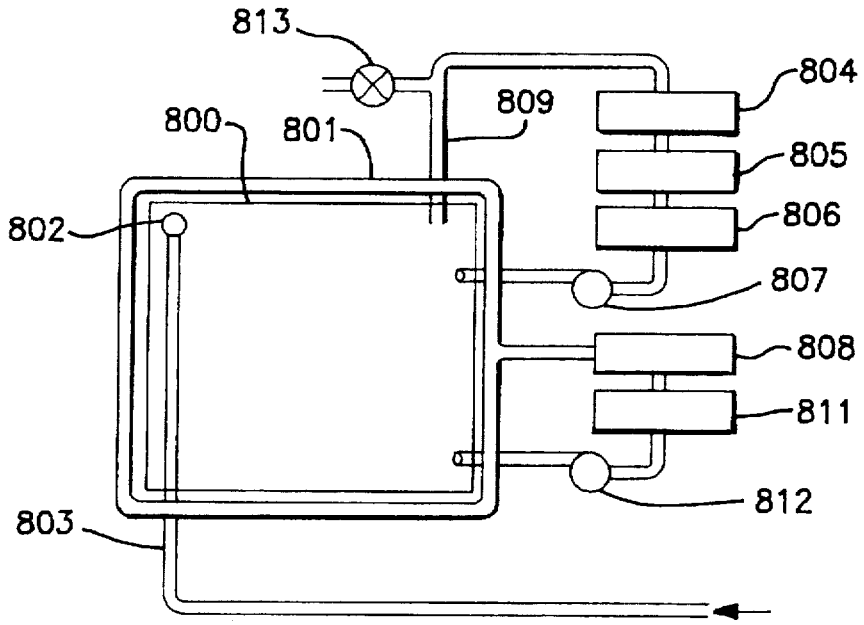
FIG. 8: shows a block diagram of the water recirculating and conditioning means.

Preferably the liner forms a basin of approximately the same dimensions as the cavity formed by the assembled panels within the frame 100, and preferably the open border of the liner is provided with a number of fixing points 307 so that it does not sag down and allow the water to escape. One preferred attachment means is shown in FIG. 3, where the liner 304 emerges from the depths of the pool to cover the upper support beam 302 and is passed under one of a number of fixing studs 307—which may be a press fit through apertures into the beam. Another, less preferred means for fixing the liner to the upper margin of the cavity is to provide a continuous sewn loop about its border, through which a galvanised iron pipe may be passed to act as a weight-bearing structure. Alternatively a capping may be placed over the liner. Optionally there may be inlets or couplings from the side of the liner to water supplies, pump exhausts, and the like. (These are indicated in FIG. 8.)

The frames (see FIG. 1 or FIG. 2) and panels are preferably made of galvanised iron sheet or alternatively of aluminium or an aluminium alloy; their surfaces treated with (for example) powder-coated epoxy or the like to minimise rust, enhance appearance, and improve durability. Given that powder-coating materials tend to chip or flake, a preferred coating comprises both a zinc treatment and a powder coating treatment on top. The frames of the apparatus are alternatively made from optionally galvanised steel pipe; bent or welded into shape. Aluminium or an aluminium alloy pipes may be used. Their function is to support the array of panels; provide a form for the apparatus, and bear the weight of a person entering or leaving the water. For example, four side frames may be provided, with two end frames.

Preferably the frames and in particular the panels are perforated with an array of apertures in order to minimise their weight; the apertures being placed where internal stresses are of relatively low level. Preferably the holes are stamped, and may also be provided with turned edges bent at a comparatively large radius and turned away from the water container, in order to minimise any pressure points against which the liner may become worn, and in order to increase panel stiffness. Stiffness may be improved by providing a deliberate curve in one or more axes, or even a pattern of corrugations on each sheet. Thus the entire panel may be created in a press.

Preferred panel dimensions are set by the gaps between the frames, which should be covered by panels. Alternatively, panels may be made of wood (for example, marine ply) or of a plastics material such as recycled polyethylene. Preferably the panels are provided with fasteners or at least fastening means in order to hold them in place and to hold the frames together. Those panels towards the base of the apparatus will be subjected to significant tension.

Optionally the base of the apparatus may not be provided with panels; the liner may be placed on the floor of the space in which the apparatus is to be used. This may help reduce costs. It is preferable for the frames to be connected beneath the water container to each other. As the effect of the weight of the water will be to impose tensions on these connections, and as steel has tensile strength, these connections will help the pool to maintain its shape.

It will be evident that the use of a series of frames with panels provides the apparatus with a modular nature so that different conformations of it may be put together for particular requirements or within certain spaces so that the use of an available space can be optimised. The liner, being of single-piece construction, is generally not modular, and a range of sizes of liner may be required.

Figure 4:
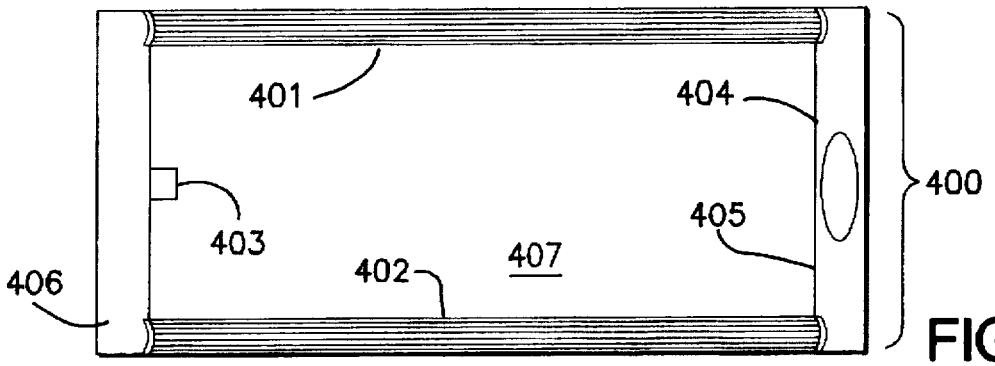
FIG. 4: shows a rectangular pool from above.
Figure 5:
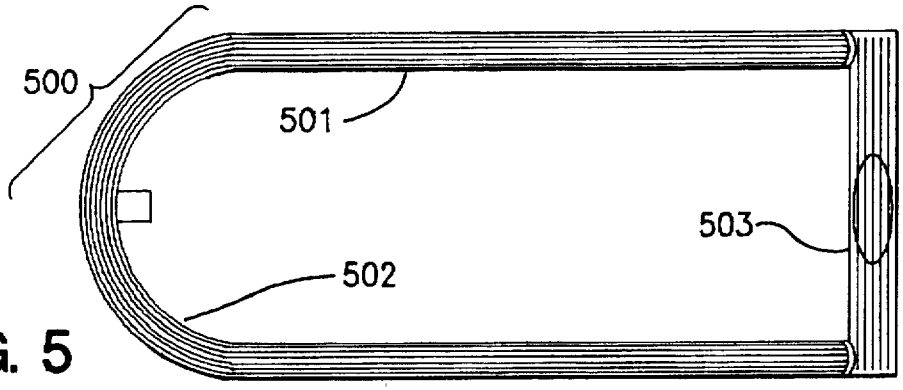
FIG. 5: shows a pool with an arcuate outline at one end.

Pools may be rectangular as shown in FIG. 4, or either end may be curved as shown in FIG. 5. Both ends may be curved. In FIG. 4, 401 and 402 are the long sides here including guttering with apertures, (though the ends may also be equipped with gutters), 403 is a swimmer attachment point, 404 is an optional control panel for the mechanisms of FIG. 8. FIG. 5 illustrates a similar pool with one curved end.

After construction, the upper rim of the water container will preferably be substantially level—to a tolerance of say 10–30 mm—so that the distance between the water and the lip of the container is consistent. In use the container will preferably be totally filled or almost totally filled with water so that the water is on the verge of overflowing This will enable the wave dampening facility, which operates as described below.

In order to prevent spillage, the rim 302 of the pool is provided with a substantial circumferential drain or gutter 108, 300 which serves to catch any waves displaced by activity on the part of the user, and feed the water back to a recycling device, such as a pump 812. Deliberate use of splash-over is employed to minimize the reflection of waves from the edge, so that the water within the container does not become too turbulent during strenuous use. Thus a swimmer within the relatively small pool that this apparatus provides will be in an environment not dissimilar to that of a conventional large pool, in terms of waves. In this mode of operation, all that portion of a wave which exceeds the mean surface level (preferably set by judicious filling) of the container overflows the sides of the container and enters the gutter, and hence is substantially not reflected back into the pool. Generally waves close to an active swimmer are somewhat asymmetrically about the mean level, in any case.

Water circulation is indicated in the block diagram of FIG. 8. In this diagram the actual pool is 800. The gutter 801 is arranged to feed into the inflow of a pump 812 which raises the water to a pressure which can cause its return into the substantially full container or pool. A suitable pump may be an axial-flow pump for its expected operating conditions tend to be high volume and low pressure. The pump could be arranged to provide a current sufficient to swim against, but that is relatively uneconomical of pump capacity and electric power and is not a preferred option. The pump may optionally be preceded by a filter 808 (which for convenience may be placed within the gutter as the optional layer 310). The filter may be followed by a second filter 811.

The pool can optionally be provided with means to purify the water, such as an intake 809 to a pump 807 and filter unit which steadily recirculates the water from the pool, through a filter, and back into the pool, or a chlorination device, or some other means to minimise bacterial and/or algal contamination. The inlet leading to 804 takes water from the pool, filters it in 804, and senses chlorine levels and adds chlorine at 806 before being returned by the pump 807. Chlorination may be implemented by making the water slightly salty and electrolysing it. The pool can optionally be provided with means 805 to warm the water, such as a heating element arranged in conjunction with the filter system, or an external heating pad placed beneath the liner and on top of a thermal barrier. Optionally the heater may be equipped with a time switch. An outlet or draining tap 813 is conveniently attached to the intake 809.

In order to minimize the peak capacity required of the pump, the gutter 108 may be relatively capacious, thus providing an inlet reservoir. This could be implemented by providing a two-part gutter; an upper part including a number of inlet or drainage apertures 311 and a lower part running beneath the upper part, and optionally beneath a filter layer 310, which spaces also act as an inlet reservoir. The drainage holes are preferably small enough to trap and filter out foreign bodies. Preferably the outer walls 301 of the gutter are high enough to catch substantially all the splashes created during active swimming. The profile shown at 108 is preferable to that of FIG. 3. Optionally the drainage system also provides a pool filtering function, with a filter incorporated between the upper part and the lower part of the drain. This may be able to filter out bacteria and the like.

Preferably the system of gutters provides at least one place where access to the interior of the pool is permitted. This could be by way of a small ladder or step covering the gutter at one place, although the exterior framing 105, 107, 109 may include such ladder or step to provide sufficient access to the interior of the pool.

Figure 7:
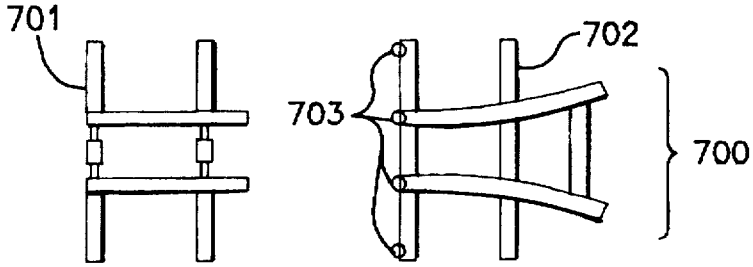
FIG. 7: shows a harness.

The swimmer is preferably provided with a harness, to restrain him or her so that swimming activity does not lead to collision with an end of the pool. The harness itself is a shoulder harness (as shown in FIG. 7, where 701 is the front portion and 702 is the back portion, with rings 703 for attachment to a repelient line 1. Preferably, the harness does not incommode the wearer in any, way. We have found that a harness connected to a resilient line 601, such as a tension spring or a rubber cable such as that used in bungy jumping is greatly preferable to one connected to a non-resilient line. The other end of the line is tied to a side of the pool, or preferably to a pole 602 extending upward from the boundary of the pool 600 at one end. Optionally the pole may be made of a resilient material. The preferred line length and resilience is such that the swimmer finds himself or herself in about the middle of the pool when swimming strongly.

The pool is preferably provided with an emptying tap and pipeline (not shown) for use when it is to be drained, and preferably has a height-sensitive filling device such as a ballcock valve 802 fed from a mains water supply pipe to maintain it filled at about the preferred height.

For applications in physiotherapy, where the apparatus may be used in a hospital or the like for rehabilitation, there may be a requirement for different harnesses and for a hoist of some type to lift people into or out of the water. There are so many different possibilities that it is difficult to list the number of types of restraint and purpose that may be used for rehabilitation and physiotherapy; however, back problems or problems anywhere along the vertebral column lend themselves to swimming exercise, as does restoring at least some muscle tone after a debilitating illness before the person can support his own weight on land. Swimming is a useful way to restore leg and back function without having to bear the weight of ones body. For such purposes there may be an increased need for vigilance (in terms of water conditioning; disinfection and the like) for preventing cross-infection between patients who may have suffered injury or had operations. The relatively small capacity of this apparatus may permit complete emptying and re-filling between patients.

For application in gymnasiums, there is also an increased need for water sterilisation and here the capacity and effectiveness of the filter may need to be enhanced. Either as well as, or instead of, there may be a continual bleed at the outlet, so that a steady flow of replacement water is provided. We believe that individual small pools are preferably to larger pools for massed exercise, although different applications will no doubt be accompanied by different preferences.

EXAMPLE 2:

This is a compact swimming pool made of typically two fibreglass parts which are bolted together side-to-side by means of a connecting flange equipped with bolt holes and sealing means such as a gasket, in order to form a tank. They can be nested for transportation or storage. Apart from fibreglass, other plastics materials (preferably rotationally moulded) or galvanised steel, or concrete, or other materials may be used.

Figure 9:
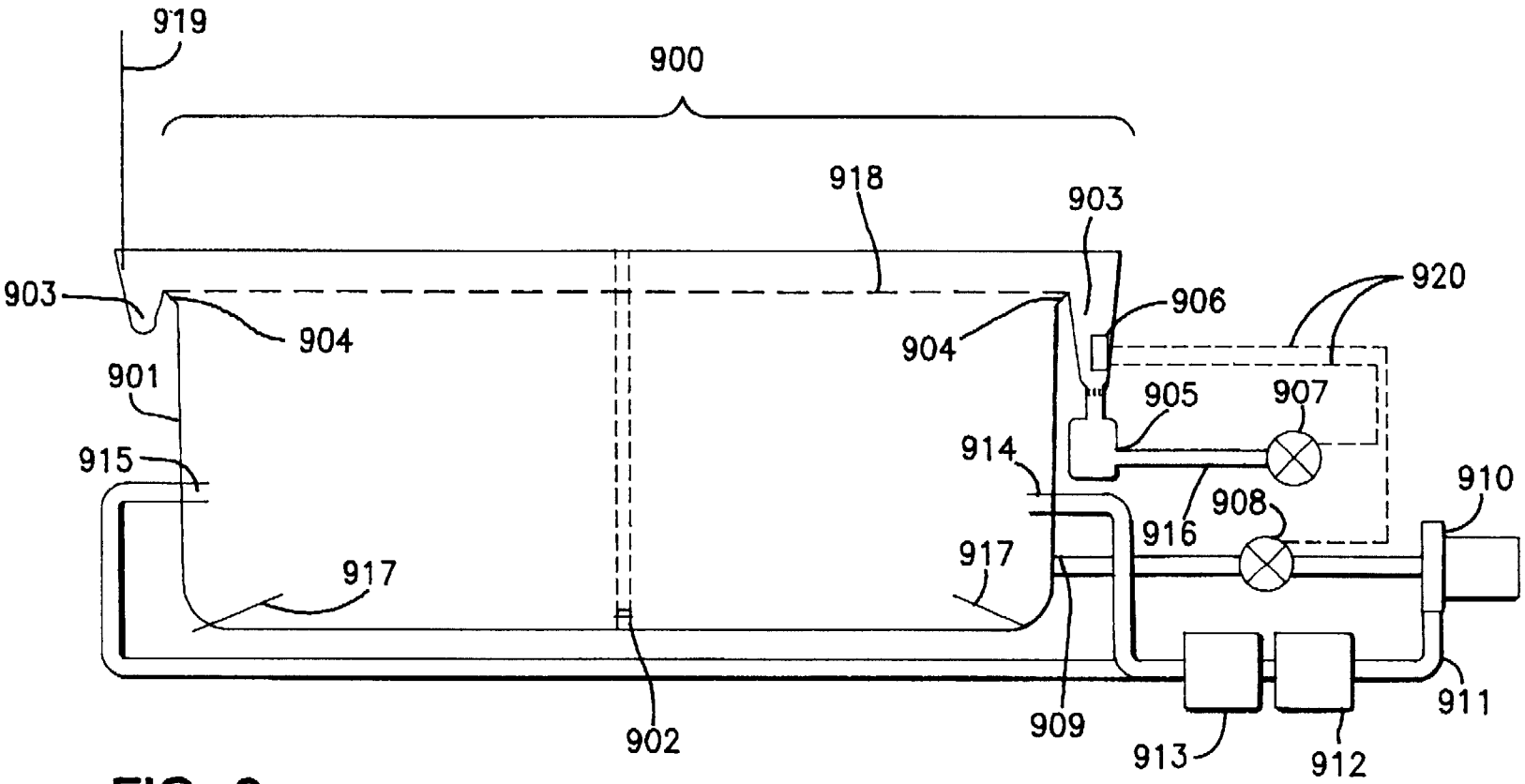
FIG. 9: shows a fibreglass, two-part tank, and water recirculation means.

FIG. 9 illustrates such a compact swimming pool 900 in an elevation view. One fibreglass part 901 is to the left; there is a flange 902 at the mating surface, and the other part is at the right. A gutter 903 surrounds the pool. It has a skimming lip 904, at about the average water height 918. The gutter falls towards the right side from where it is drained, towards a pump 910 via a conduit 916, a valve 907 and an optional solids trap 905. Preferably the drain commences with a pool cap to minimize whirlpool formation. The valve 907, and the valve 908 are controlled (via lines 920) from the float valve 906 which senses the water present in the gutter, and controls them so that 907 opens when there is sufficient water in the gutter for pumping to occur, and opens valve 908 (drawing water from the pool through intake 909) when there is not sufficient water. Preferably there is a "make-before-break" action so that the operating pump 910 is not presented with a closed-off input. This effect might be provided by having a slower closing action than an opening action for each valve. The pump outflow (911) is passed through water conditioning devices such as a heater 912 and a sterilizing/filtering unit 913, though these are optional. Flow is returned through outlets 914 and 915 into the pool. It has been found that multiple outlets of this type can reduce "slop"—a large wave passing from end to end, perhaps by confusing the wave with internal turbulence. Another option for reducing slop is internal baffles 917, which serve to break up currents reaching the base of the pool. An option for containing splashes is curtains or hung sheets 919 and draining into the gutter. Note that we have not illustrated a supply pipe and valve for maintaining the pool water level in case of evaporation, or splashing out. The valve may be a conventional float-controlled valve as in FIG. 8.

Compact swimming pool dimensions.

Length including gutters: 4 m; excluding gutters; 3.6 m
Height including gutters: 1.2 m; excluding gutters; 1 m
Width including gutters: 2 m; excluding gutters; 1.6 m.

These dimensions are, of course, not limiting. We are still experimenting with optimal dimensions of gutters and the capacity of the pump.

The flange 902 may, around the sides, be produced so as to face towards the outside of the pool so that it does not obstruct the swimmer, or it may be produced to face towards the inside on the base (as illustrated) so that the bottom of the pool can rest on a flat surface, not requiring bearers. In the ladder case the interior of the pool is preferably smoothed so that the swimmer's feet are unlikely to be injured.

The preferred water level sensor 906, responsive to the presence of a reasonable volume of water—such as a litre or more, is used to control the switching action of valves 907 and 908 and would comprise an electric output from a float; perhaps driven by a waterproof microswitch coupled to a float, or perhaps a magnetic float and a Hall effect sensor, the output of which is boosted so that a solenoid valve or valves can be controlled. Solenoid valves seem convenient and preferable. Of course a pneumatic or fluidics valve system could be devised, needing no external motive force (electric current in this example) but we prefer to use standard pool components where possible. Hence an isolated power supply is provided for energising the control valve system.

Figure 6:
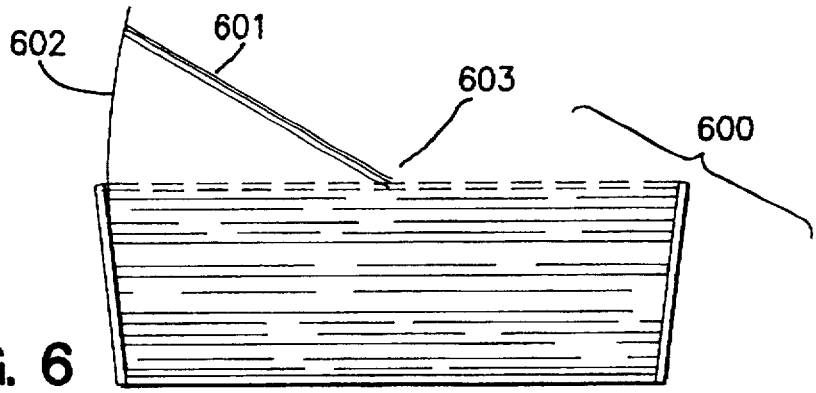
FIG. 6: shows apparatus used to restrain a swimmer who is practicing in the pool.

The pump itself may be any convenient type; a 2 kW electrically driven centrifugal pump is preferred. This pump has an in-circuit throughput of about 400 litres per minute. Because stopping and starting such a pump is annoying to the user and deleterious to the electric motor, we have provided the above valve arrangement so that the pump can operate continuously and smoothly. The pump could be of sufficient capacity to provide a flow of water that the swimmer can swim against, so that the compact swimming pool is effectively of infinite length, but we prefer to give the swimmer a restraining harness with a resilient attachment to a fixed pole (see FIG. 6 - 601) to swim against. In FIG. 9 opposing return currents are shown, from outlets 914 and 915. The pump could be of sufficient capacity to provide a unidirectional flow of water that the swimmer can swim against, but we prefer to give the swimmer a restraining harness with a resilient attachment to a fixed pole to swim against. This harness is made up from part (1); a harness which can be either a full jacket type of just a waist type, (2) an elastic cord (such as bungee cord) or a spring, connecting the harness to (3) a restraining pole mounted at one end of the pool so that it projects above the surface of the pool. It may also be resilient and can be adjusted in order to suit various classes and sizes of swimmers. Preferably the fixed point can be adjusted vertically, and also moved out over the pool. The cord to the harness should be raised, so that it does not tangle with the swimmer's legs and does not tend to pull the swimmer down. A child would also prefer a lifting type of pull.

Preferably at least some of the outflow from the pump passes through water conditioning apparatus, such as a filter, and/or a sterilizing arrangement 913. One sterilizing arrangement is a chlorination plant. This can be effected by electrolysis of a slightly salty water, or by adding calcium hypochlorite, or the like. A heater, such as a spa-pool 5.5 kW heater 912, may be used in line with the pump's outflow, and here the relatively steady flow provided by the control valve arrangement is useful to prevent overheating.

ALTERNATIVES

Further variations include the provision of curtains 919, supported so as to hang with weighted borders into the gutters in order to catch splashes. A larger pool size may be preferable for more than one person to use the pool simultaneously. The concept of panels having watertight seals at the flanges has been discussed above.

ADVANTAGES

This compact swimming pool provides an environment where a person can conveniently partake of strenuous swimming exercise within a small space, and most of the splashing and the waves thereby generated are contained.

Finally, it will be appreciated that various alterations and modifications may be made to the foregoing without departing from the scope of this invention as set forth.

I claim:

1. A compact swimming pool for providing a swimmer with a training installation, the compact swimming pool comprising a tank for holding water and resilient restraint means to hold a training swimmer in a relatively stationary position within the compact swimming pool; wherein:

the tank is surrounded by an overflow gutter;

the gutter has a skimming lip, a base, and an exterior wall;

the skimming lip forms a top perimeter of the tank, the exterior wall of the gutter is higher than the skimming lip to contain water splashes within the gutter;

the base of the gutter slopes from one end of the pool to the other, with the deepest portion of the gutter being capacious enough to form a reservoir;

the reservoir having an outlet conduit connected to pump means, the pump means being connected to at least one return conduit which is connected to an aperture in the tank below the skimming lip;

whereby in use the tank is filled to overflowing, so that water collects in the reservoir, and when a swimmer is exercising in the pool, the presence of the swimmer will cause additional water to overflow from the tank into the gutter and into the reservoir, the water being returned to the tank by the pump means to maintain an average water level at about the level of the top of the skimming lip.

2. A compact swimming pool as claimed in claim 1, wherein the resilient restraint means comprises a harness capable of attachment to the swimmer's body, the harness being connected to a resilient line capable of being attached to anchor means associated with the compact swimming pool.

3. A compact swimming pool as claimed in claim 2, wherein the anchor means comprises a pole connected to the compact swimming pool, one end of the pole extending above the gutter.

4. A compact swimming pool as claimed in claim 3, wherein valve means is provided between the reservoir and the pump means, the valve means being controlled by a sensor which senses the level of water in the reservoir.

5. A compact swimming pool as claimed in claim 4, wherein the pump means is provided with a source of water directly from within the compact swimming pool in the event of there being insufficient water within the reservoir to act as a source, said provision being by means of second valve means having control means preferentially selecting the reservoir as a source if sufficient water is present in the reservoir.

6. A compact swimming pool as claimed in claim 5, wherein at least one of the conduits returning water to the compact swimming pool is provided with in-line water conditioning means.

* * * * *